United States Patent [19]

Mulkern

[11] Patent Number: 4,764,764

[45] Date of Patent: Aug. 16, 1988

[54] WRITE-PROTECT APPARATUS FOR BIT MAPPED MEMORY

[75] Inventor: Joseph Mulkern, St. Paul, Minn.

[73] Assignee: Honeywell Inc., Minneapolis, Minn.

[21] Appl. No.: 675,112

[22] Filed: Nov. 27, 1984

[51] Int. Cl.[4] ..... G09G 1/00

[52] U.S. Cl. ..... 340/724; 340/721; 340/747

[58] Field of Search ..... 340/721, 723, 724, 747, 340/750, 798, 799

[56] References Cited

U.S. PATENT DOCUMENTS

| | | | |
|---|---|---|---|
| 3,497,760 | 2/1970 | Kiesling | 340/722 |
| 3,639,736 | 2/1972 | Sutherland | 340/724 |
| 3,889,107 | 6/1975 | Sutherland | 340/747 |
| 3,996,673 | 12/1976 | Vorst et al. | 340/747 |
| 4,492,956 | 1/1985 | Collmeyer et al. | 340/723 |
| 4,663,618 | 5/1987 | Hayles et al. | 340/732 |

*Primary Examiner*—Marshall M. Curtis
*Assistant Examiner*—Mahmoud Fakahigar
*Attorney, Agent, or Firm*—Seymour Levine; Albin Medved

[57] ABSTRACT

A pattern write protect system approximates a memory area for data entry with a multiplicity of rectangles and determines when a point for entry is within the window by establishing a relative position of the address point coordinates to the coordinates of the sides of the rectangles. A less than/greater than signal for each address coordinate relative to the sides of each rectangle is derived. These signals are summed and the resulting sum signals are then multiplied to provide an enable gate signal.

6 Claims, 3 Drawing Sheets

WRITE-PROTECT APPARATUS FOR BIT MAPPED MEMORY

The Government has rights in this invention pursuant to a Contract awarded by the Department of the Army.

BACKGROUND OF THE INVENTION

1. Field of the Invention

The invention pertains generally to the field of electronic graphic systems and more particularly to write-protecting areas or patterns of a bit mapped memory used in these graphic systems.

2. Description of the Prior Art

Graphic systems typically use full field or bit mapped memories configured in an X, Y plane format to hold information for utilization in the generation of a graphic display. These memories are X and Y addressed for entering one bit of data at each addressed point. Data stored in this manner is subsequently displayed on a CRT as an X, Y plane graphic.

A vector generator, directed by a central processing unit (CPU) software, creates a display for entry into the bit map memory. In a real time graphic system speed or execution time is an important factor. This speed may be achieved by using a set of routines each configured to draw different parts of the display. These routines are repeated for each frame of the display system with only the input data altered to reflect dynamic changes. This procedure, however, may cause segments of one routine to be drawn over an area controlled by another routine when the input coordinates are changed. In the prior art this over lapping is eliminated with software having limits set therein which, when exceeded, cause unwanted segments of a routines display to be erased. These prior art remedies, however, require additional execution time, thus adversely affecting the speed of the display system. Some prior write-protect circuits use a PROM mask. These masks require large PROM sizes, extra chips to latch addresses and to multiplex output signals, and exhibit slow access times.

A need exists for a write-protect system capable of detecting when a write operation is inside or outside of a specified area or pattern with sufficient speed to respond within a single write operation.

SUMMARY OF THE INVENTION

In accordance with the present invention, pattern write protection for bit map memories is accomplished by providing interior/exterior detection for a multiplicity of defined rectangles. The detection circuits are combined to provide an output that indicates whether a write attempt is being made inside or outside of a desired pattern. This output signal is coupled to the bit map memory enable terminal, thus permitting data entry only when the write attempt is within the specified pattern. Combinational logic is used for detector circuits, requiring only three gate delays between the address input terminals and the enable terminal of the bit memory.

DESCRIPTION OF THE PREFERRED EMBODIMENT

Figure 1:
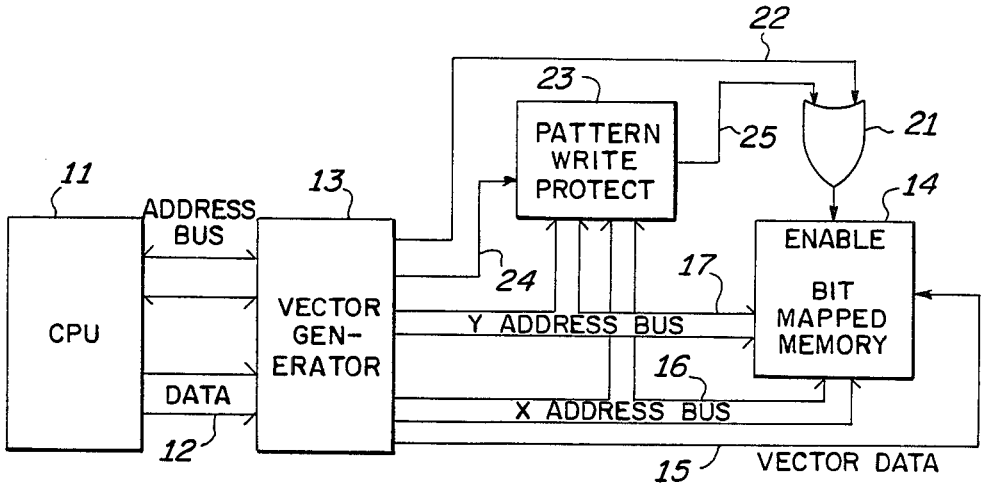
FIG. 1 is a partial block diagram of a graphic display system.

Refer to FIG. 1 wherein a block diagram of apparatus for entering data into a bit mapped memory to establish therein a graphic display in X-Y format is presented. Data from a central processing unit 11 is coupled via a data bus 12 to a vector generator 13, wherefrom vector data and address codes are coupled via line 15 and buses 16, 17 to bit mapped memory 14. Vector data on line 15 is stored in the bit mapped memory 14 at points determined by the X address code on bus 16 and the Y address code on bus 17, each X, Y address having one bit of vector data stored therein. Vector generator 13 additionally provides an enable signal coupled to an OR gate 21 via line 22 and a position signal to a pattern write protect circuit 23 via line 24. The pattern write protect circuitry 23 couples a low level signal to OR gate 21 via line 25 when the vector data on line 15 is for entry within a permissible region of the X-Y display and a high level signal to the OR gate 21 otherwise. When a low level signal is coupled from OR gate 21 to the enable terminal of bit mapped memory 14 the vector data on line 15 may be written therein at the addressed position.

Figure 2:
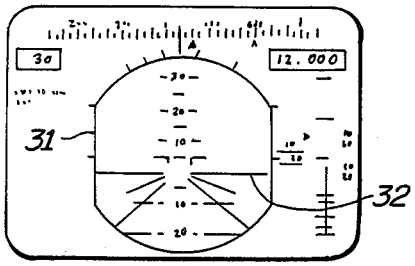
FIG. 2 is an illustration of a vertical situation display window.
Figure 3:
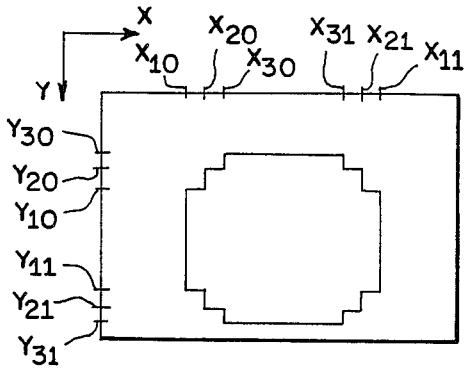
FIG. 3 is an approximation to the window of FIG. 2 formed by superposing three rectangles.
Figure 4:
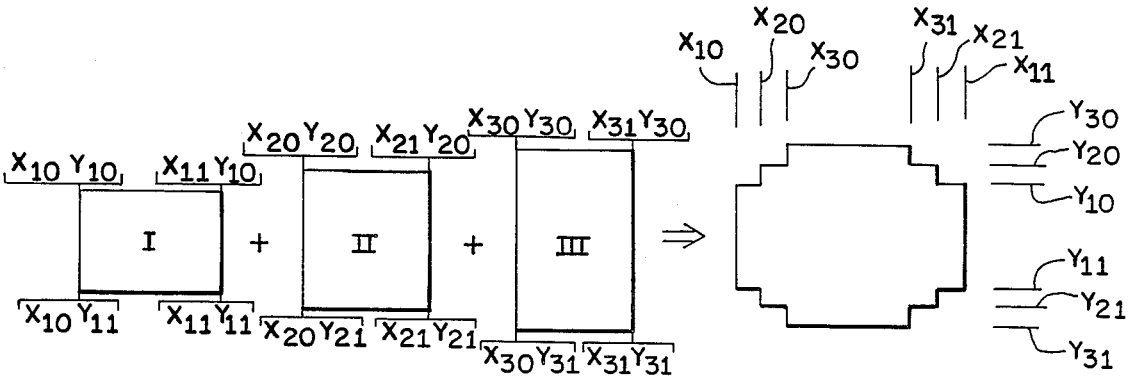
FIG. 4 illustrates the window formation of FIG. 3.

In FIG. 2 a representation of a vertical situation display is shown. This display contains a window having periphery 31 within which a Roll-Pitch Indicator 32 is displayed. To prevent the deletion of data that is displayed outside the window, the Roll-Pitch Indicator 32 must be contained within the periphery 31. The periphery 31 may be approximated by superposing a multiplicity of rectangles as shown in FIGS. 3 and 4. In these Figures X coordinates increase to the right and Y coordinates increase down as shown in FIG. 3. By superposing three rectangles I, II and III, having the corner coordinates shown, the window periphery may be approximated as shown in FIG. 4. The pattern write protect circuit 23 of FIG. 1 performs to ensure that the Roll-Pitch indicator 32 is displayed soley within the periphery of the window 31. Though FIGS. 3 and 4 show an approximation to the window by superposing three rectangles, it should be evident that a finer approximation to the window periphery may be obtained by using additional rectangles. The coordinates of each point on the Roll-Pitch Indicator 32, originating in the vector generator 13, are coupled to the pattern write protect circuit 23 wherein a comparison with the coordinates of the rectangles approximating the window periphery 31 is made.

Figure 5:
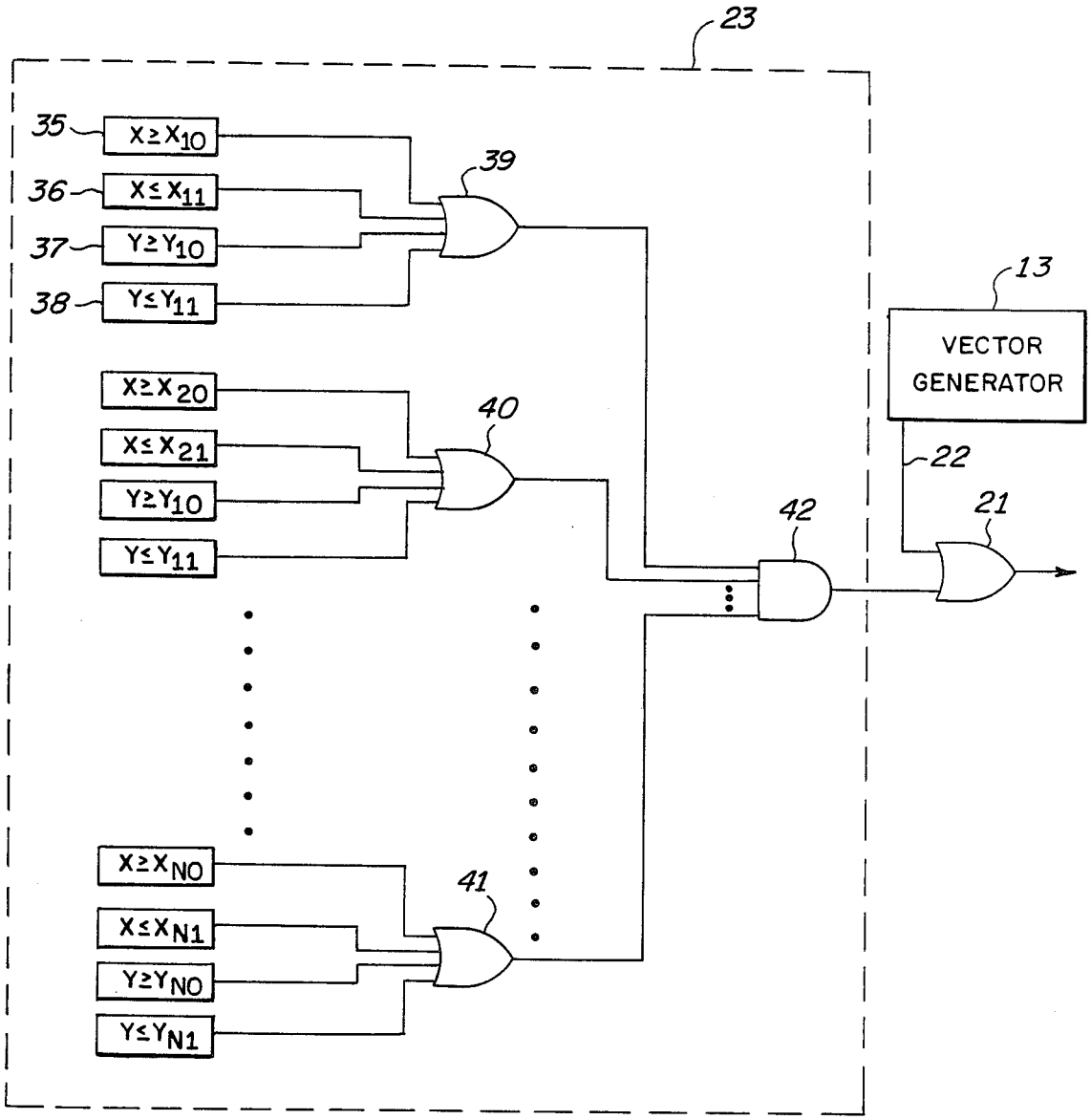
FIG. 5 is a logic diagram of an interior/exterior detector for a pattern formed with N rectangles.

In FIG. 5 a circuit is shown wherein each point on the Roll-Pitch Indicator 32 is compared with the boundary coordinates of the rectangles that are used to approximate the window periphery 31. Comparator 35 provides a low level signal when the X coordinate of the point is equal to or greater than the X coordinate of the line $X_{10}$ while the comparator 36 provides a low level signal when the X coordinate of the point is equal to or less than the coordinate of the line $X_{11}$. Similarly, the comparator 37 provides a low level signal when the Y coordinate of the point is equal to or greater than the Y coordinate of the $Y_{10}$ and a low level signal when the Y coordinate of the point is equal to or less than the Y coordinate of the line $Y_{11}$. Thus four low level signals are coupled to OR gate 39 to provide a low level output signal therefrom. If a point on the Roll-Pitch Indicator 32 is not within the rectangle I at least one output signal of the comparators 35–38 will be at a high level, thereby establishing a high level signal at the output terminal of OR gate 39. Similar comparisons are made for all the rectangles approximating the window periphery to provide low level signals at OR gates having input terminals coupled to the comparators for each rectangle when a point on the Roll-Pitch Indicator 32 is within that rectangle. The output terminals of each OR gate, such as 39, 40, and 41 are coupled to the input terminals of an AND gate 42. If the point on the Roll-Pitch Indicator 32 is in anyone of the rectangles approximating the periphery 31, that point is within the window boundary and is eligible for display. Since AND gate 42 provides a low level signal at the output terminal thereof when at least one input terminal has a low level signal coupled thereto, it is evident that a low level signal at the output terminal of AND gate 42 indicates that the point is within the window boundary. The output terminal of AND gate 42 is coupled to one input terminal of OR gate 21, a second input terminal of which, as previously stated, is coupled to receive enabling signals from vector generator 13. OR gate 21 therefor provides a low level signal to enable the bit mapped memory 14 during the generation of the Roll-Pitch indicator 32 for each point generated that is within the periphery 31 of the window, otherwise a high level signal is provided to the enable terminal of the bit mapped memory 14 and the point is not entered for subsequent display.

Figure 6:
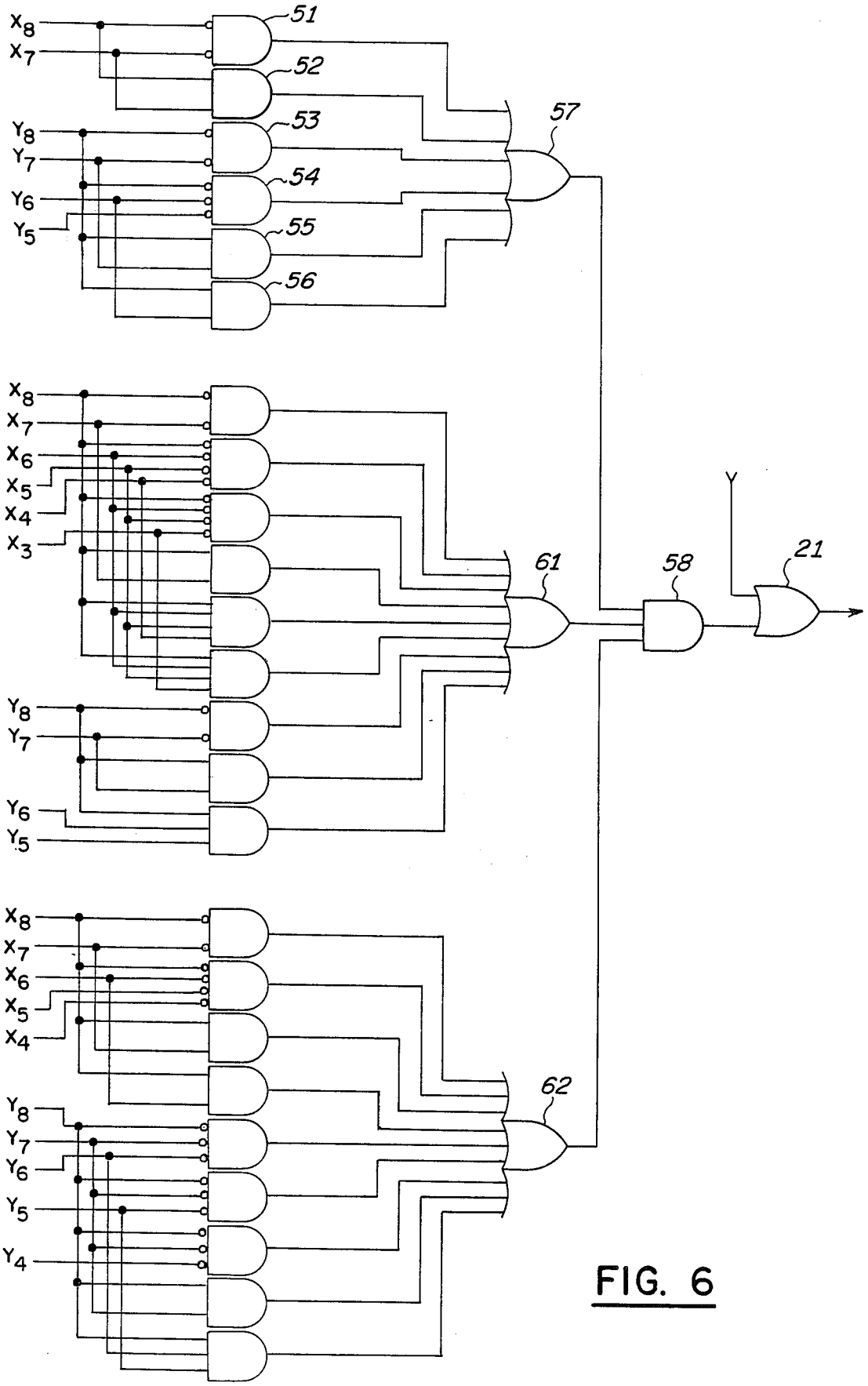
FIG. 6 is a logic diagram for an interior/exterior detector for the pattern of FIG. 4 with specified rectangular boundries.

Refer now to FIG. 6 wherein a preferred embodiment of a comparator for the three rectangle approximation to the window is shown. This comparator forms a sum of products (SOP) of selected bits from the address of each point. Each boundary may require more than one selected bit of the boundary for proper comparison and thus may require more than one product for each coordinate. Consider the boundaries for the three rectangles of FIG. 4 as shown in Table 1.

TABLE I

| | BOUNDARY | DECIMAL | BINARY $X_8$ / $Y_8$ | $X_7$ / $Y_7$ | $X_6$ / $Y_6$ | $X_5$ / $Y_5$ | $X_4$ / $Y_4$ | $X_3$ / $Y_3$ | $X_2$ / $Y_2$ | $X_1$ / $Y_1$ | $X_0$ / $Y_0$ |
|---|---|---|---|---|---|---|---|---|---|---|---|
| I | $X_{10}$ | 128 | 0 | 1 | 0 | 0 | 0 | 0 | 0 | 0 | 0 |
| | $X_{11}$ | 384 | 1 | 1 | 0 | 0 | 0 | 0 | 0 | 0 | 0 |
| | $Y_{10}$ | 160 | 0 | 1 | 0 | 1 | 0 | 0 | 0 | 0 | 0 |
| | $Y_{11}$ | 320 | 1 | 0 | 1 | 0 | 0 | 0 | 0 | 0 | 0 |
| II | $X_{20}$ | 152 | 0 | 1 | 0 | 0 | 1 | 1 | 0 | 0 | 0 |
| | $X_{21}$ | 360 | 1 | 0 | 1 | 1 | 0 | 1 | 0 | 0 | 0 |
| | $Y_{20}$ | 128 | 0 | 1 | 0 | 0 | 0 | 0 | 0 | 0 | 0 |
| | $Y_{21}$ | 352 | 1 | 0 | 1 | 1 | 0 | 0 | 0 | 0 | 0 |
| III | $X_{30}$ | 192 | 0 | 1 | 1 | 0 | 0 | 0 | 0 | 0 | 0 |
| | $X_{31}$ | 320 | 1 | 0 | 1 | 0 | 0 | 0 | 0 | 0 | 0 |
| | $Y_{30}$ | 96 | 0 | 0 | 1 | 1 | 0 | 0 | 0 | 0 | 0 |
| | $Y_{31}$ | 368 | 1 | 0 | 1 | 1 | 1 | 0 | 0 | 0 | 0 |

Each boundary is represented by a nine bit binary number as shown in the Table. It should be evident that all X coordinate values, within the coordinate range of interest, that are less than the X value of the boundary $X_{10}$ show zeros for the binary digits $X_8$ and $X_7$. By inverting these binary digits and multiplying in AND gate 51 a high level signal will be provided when ever an X coordinate is less than the X value of the boundary $X_{10}$ and a low level signal will appear at the output terminals of AND gate 51 when the X-coordinate exceeds the value of the boundary $X_{10}$. It is further evident from Table I tthat points having X coordinates that are less than the coordinate of the X boundary $X_{11}$ will have at least one zero for the $X_8$ and $X_7$ digits. Coupling these digit levels to an AND gate 52 therefor provides a low level signal at the output terminal of an AND gate 52 which persists until the X coordinate of the point exceeds the $X_{11}$ position. At this time a high level signal exists for both the $X_8$ and $X_7$ digits, causing a high level signal to appear at the output terminal of AND gate 52.

AND gates 53, 54, 55, and 56 provide the logic for the determination that the Y coordinate of the point is greater than the value $Y_{10}$ and less than the value $Y_{11}$. Coupling inverted digits $Y_8$ and $Y_7$ to AND gate 53 provides a low level signal for all binary values greater than 001111111 and the product of the inverted digits $Y_8$, $Y_6$ and $Y_5$ given by AND gate 54 provides a high level signal for all digital values between 001111111 and 010100000 and thereafter a low level signal. Thus AND gates 53, 54 both provide low level signals for all values greater than $Y_{10}$, while at least one provides a high level signal for values less than $Y_{10}$. Logic for the upper boundary of the Y coordinates is provided by AND gates 55, 56. Binary digits $Y_8$ and $Y_7$ are coupled to the input terminals of AND gate 55 while binary digits $Y_8$ and $Y_6$ are coupled to the input terminals of AND gate 56. AND gate 55 provides low level signals for all digital values equal to or less than 101111111 after which a high level signal will appear for coordinate values up to an including 111111111. AND gate 56 will provide high level signals between the binary numbers 111111111 and 101000000 inclusive and a low level signal for all binary values of interest above and below this range. Though both AND gates 55 and 56 provide low level signals for the Y coordinate of the point greater than the 111111111, high level signals are provided by AND gates 53 and 54 for the remainder of the binary values of interest. The output terminals of AND gates 51–56 are coupled to an OR gate 57, the output terminal of which is coupled to an input terminal of an AND gate 58. When the X and Y coordinates of a point are within the boundaries of rectangle I OR gate 57 couples a low level signal to AND gate 58 otherwise OR gate 57 couples a high level signal to AND gate 58. Similarly low and high level signals are respectively coupled from OR gate 61 and 62 to AND gate 58 to indicate the location of a point relative to rectangles II and III. Should at least one low level signal be coupled to AND gate 58, thereby indicating a point that is within at least one of the rectangles, AND gate 58 couples a low level signal to one terminal of OR gate 21, the other terminal of which is coupled to receive the write enable signal from the vector generator 13. Thus OR gate 21 couples a low level signal to the bit mapped memory 14 when a write enable signal is received from the vector generator 13 and a point for entry into in the memory is within one of the rectangles representative of the display window.

While the invention has been described in its preferred embodiments, it is to be understood that the words which have been used are words of description rather than limitation and that changes may be made within the purview of the appended claims without departing from the true scope and spirit of the invention in its broader aspects.

I claim:

1. An apparatus having a memory unit arranged in accordance with a defined coordinate system for enabling data entry at selected coordinate locations within a boundary, established in the memory, which defines a data entry window comprising:

means for generating address coordinate signals representative of points in said coordinate system whereat data are to be entered;

means for approximating said window by a multiplicity of overlapping planar geometrical figures each having a predetermined boundary in said memory and for providing boundary signals representative of locations of said boundaries;

position means coupled to receive said boundary signals and said address coordinate signals for providing position signals representative of locations of said address coordinates relative to said boundary of each of said planar geometrical figures, thereby providing a multiplicity of position signals each representative of an address coordinate location relative to a boundary segment of one of said geometrical figures;

location means coupled to receive said position signals for providing window signals representative of said locations of said address coordinates relative to said window, said window signals indicating that a data point is within said window when said position signals indicate that said data point is within at least one of said geometric figures; and means coupled to receive said window signals for providing a data entry enabling control signal to said memory unit when a window signal indicates that a point at which data is to be entered is in said window.

2. An apparatus in accordance with claim 1 wherein each geometrical figure is a rectangle having boundary segments including a first side at a first value of a first coordinate, a second side at a second value of said first coordinate, a third side at a first value of a second coordinate, and a fourth side at a second value of said second coordinate, said second values being greater than said first values and wherein said position means includes:

first means for comparing a first coordinate value of a data point address to said first value of said first coordinate for providing a signal representative of said first coordinate value of said data point address being less than or greater than said first value of said first coordinate;

second means for comparing said first coordinate value of said data point address to said second value of said first coordinate for providing a signal representative of said first coordinate value of said data point address being less than or greater than said second value of said first coordinate;

third means for comparing a second coordinate value of said data point to said first value of said second coordinate for providing a signal representative of said second coordinate value of said data point address being less than or greater than said first value of said second coordinate;

fourth means for comparing said second coordinate value of said data point address to said second value of said second coordinate for providing a signal representative of said second coordinate value of said data point address being less than or greater than said second values of said second coordinate; and means coupled to receive said signals representative of coordinate values of said data point less than or greater than said first and second coordinate values of said boundary segments from said first through fourth comparing means for providing said position signals to said location means.

3. An apparatus in accordance with claim 2 wherein said first through fourth comparing means includes means for multiplying a selected binary digit of a binary signal representative of a data point address coordinate by at least one other selected binary digit of said binary signal for providing said first and second coordinate less than or greater than signals.

4. An apparatus in accordance with claim 3 wherein said, location means includes means for summing said less than or greater than signals provide said position signals.

5. An apparatus in accordance with claim 4 wherein said location means includes means coupled to said position means for multiplying said signals position to provide said window signals.

6. An apparatus in accordance with claim 5 wherein said multiplying means of position means and said multiplying means of said location means are AND gates, and said summing means are OR gates.

* * * * *